US007347040B2

(12) United States Patent
Voidel et al.

(10) Patent No.: US 7,347,040 B2
(45) Date of Patent: Mar. 25, 2008

(54) FIBER GUIDE CHANNEL

(75) Inventors: Bettina Voidel, Chemnitz (DE); Peter Voidel, Chemnitz (DE); Bernhard Schwabe, Chemnitz (DE); Hans Grecksch, Mönchengladbach (DE); Heinz-Georg Wassenhoven, Mönchengladbach (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 140 days.

(21) Appl. No.: 10/576,114

(22) PCT Filed: Aug. 3, 2004

(86) PCT No.: PCT/EP2004/008670

§ 371 (c)(1),
(2), (4) Date: Apr. 13, 2006

(87) PCT Pub. No.: WO2005/047579

PCT Pub. Date: May 26, 2005

(65) Prior Publication Data

US 2007/0148269 A1 Jun. 28, 2007

(30) Foreign Application Priority Data

Oct. 16, 2003 (DE) ..... 103 48 710

(51) Int. Cl.
*D01H 4/08* (2006.01)

(52) U.S. Cl. ..... 57/413; 57/408

(58) Field of Classification Search ..... 57/408, 57/413, 503

See application file for complete search history.

(56) References Cited

U.S. PATENT DOCUMENTS 3,538,698 A 11/1970 Ripka et al. ..... 57/58.95
3,956,876 A 5/1976 Artzt et al. ..... 57/58.95
5,295,349 A * 3/1994 Okamoto ..... 57/333
5,491,966 A 2/1996 Billner ..... 57/413
5,555,717 A * 9/1996 Schuller et al. ..... 57/413
5,581,991 A 12/1996 Billner ..... 57/413

(Continued)

FOREIGN PATENT DOCUMENTS

DE 1930 760 2/1970

(Continued)

*Primary Examiner*—Shaun R. Hurley
(74) *Attorney, Agent, or Firm*—Kennedy Covington Lobdell & Hickman, LLP

(57) ABSTRACT

A fiber guide channel for pneumatic transport of individual fibers combed from a sliver by an opening cylinder of an open end spinning device for delivery to a spinning rotor. The fiber guide channel is arranged in a cover element for the rotor housing and the input side of the fiber guide channel is matched in its width to the mountings of the opening cylinder. The inlet and the outlet openings of the fiber guide channel have a slot-like shape and the maximum extension (B) of the inlet opening extends parallel to the axis of the opening cylinder. The maximum extension (L) of the outlet opening of the fiber guide channel is rotated about an imaginary center line of the fiber guide channel by 90°±15° relative to the maximum extension (B) of the inlet opening. The fiber guide channel has a substantially cylindrical zone Z, between the inlet and outlet openings, with the cross-section of the fiber guide channel constantly decreasing from the inlet opening to the zone Z.

8 Claims, 6 Drawing Sheets

U.S. PATENT DOCUMENTS

| | | | | |
|---|---|---|---|---|
| 5,685,137 | A | 11/1997 | Raasch | 57/413 |
| 5,901,546 | A * | 5/1999 | Lovas et al. | 57/413 |
| 5,953,897 | A | 9/1999 | Wassenhoven et al. | 57/413 |
| 6,295,800 | B1 * | 10/2001 | Stahlecker | 57/411 |

FOREIGN PATENT DOCUMENTS

| | | |
|---|---|---|
| DE | 43 07 785 A1 | 9/1994 |
| DE | 195 11 084 A1 | 9/1996 |
| DE | 197 12 881 A1 | 10/1998 |
| EP | 0 311 988 A1 | 4/1989 |

* cited by examiner

FIBER GUIDE CHANNEL

CROSS-REFERENCES TO RELATED APPLICATIONS

This application claims the benefit of German patent application 10348710.7, filed Oct. 16, 2003, herein incorporated by reference.

BACKGROUND OF THE INVENTION

The invention relates to a fiber guide channel for the pneumatic transport of individual fibers, such as are combed out of a feed sliver by an opening cylinder that rotates in an opening cylinder housing of an open end spinning device for delivery to a spinning rotor.

Fiber guide channels of this type are known in connection with open end spinning devices from numerous publications.

German Patent Publication DE 195 11 084 A1 describes, for example, an open end spinning device with a sliver opening mechanism, in which a sliver temporarily stored in a spinning can, as conventional, is fed to a rotating opening cylinder, which opens the sliver into individual fibers. The individual fibers are then fed onto a spinning rotor running at a high speed in a rotor housing, via a fiber guide channel, where they are continuously rotated, in an inner rotor groove, onto the end of a yarn leaving the spinning rotor via a withdrawal nozzle. The finished yarn is then wound to form a cross-wound bobbin on an associated winding mechanism.

High demands are placed on the designs of fiber guide channels of this type, in this case, for example with regard to the geometric configuration. In other words, the flow conditions inside the fiber guide channels have to ensure that the fibers are stretched during transport or are at least kept stretched. Moreover, the surface of these components must be continuously smooth, so no fibers attach to the wall during the pneumatic transport. Moreover, harmful air vortexes forming in the boundary layer region of the fiber guide channels should be avoided as far as possible.

A comparable fiber guide channel is also described in German Patent Publication DE 197 12 881 A1. In this known mechanism, the opening cylinder housing is connected pneumatically to the spinning rotor via a multi-part fiber guide channel. This means that the fiber guide channel consists of two separate channel portions, namely a channel portion running inside a so-called fiber guide channel insert and a channel portion arranged in a channel plate adapter. During operation, in other words when the rotor housing is closed, the channel plate adapter, which, apart from the opening region of the fiber guide channel, also has a bore for fixing a thread withdrawal nozzle, extends into the running spinning rotor. It is thus ensured that the opening region of the fiber guide channel is positioned adequately closely to the fiber slide wall of the spinning rotor, so the individual fibers transported in the fiber guide channel are fed according to regulations onto the spinning rotor.

As can be seen from the two patent applications described above, the fiber guide channels have an inlet opening, the width of which is matched to the width of the opening roller mountings. In order to achieve a stretching of the fibers by acceleration of the transport air flow, the free cross-sectional area of fiber guide channels of this type is moreover generally selected in such a wav that it decreases in the direction of the outlet opening of the fiber guide channel. The outlet opening, in this case, substantially has a circular cross-section, the minimum diameter of which is predetermined by the air and fiber throughput required during spinning. The fibers are, in this case, fed onto a relatively wide region of the fiber slide wall of the spinning rotor. Fibers, which are fed onto the fiber slide face in the edge region of the spinning rotor, during their transport to the fiber collecting groove, where they are bound into the thread, are accelerated and further stretched by the rotor rotation and the centrifugal force caused thereby. Fibers, which are fed on near the rotor groove, receive significantly lower stretching, resulting in a different degree of stretching and overall reduced substance utilization with regard to the specific strength of the yarn produced.

Apart from fiber guide channels with round outlet openings, fiber guide channels with an elongate outlet opening extending substantially in the direction of the rotor periphery are also prior art.

German Patent Publication DE-OS 19 39 760 describes, for example, an open end spinning device with a fiber guide channel, which connects an opening cylinder and a spinning rotor. The fiber guide channel, in this case, may have various cross-sectional shapes, for example rectangle, trapezium etc., in particular. also in the region of the outlet opening. In principle, the channel shape from the inlet at the opening cylinder to the opening in the spinning rotor is substantially unchanged. The fibers conveyed in this fiber guide channel, for this reason, are conveyed as far as possible in the position and spread up to the fiber slide face of the spinning rotor in which they arrive from the opening cylinder into the fiber guide channel.

SUMMARY OF THE INVENTION

Proceeding from a fiber guide channel of the type described above, the invention is based on the object of developing a fiber guide channel, which has a shape ensuring a stretching and bundling of the fibers on their way to the fiber slide face.

This object is achieved according to the invention by a fiber guide channel for the pneumatic transport of individual fibers, which are combed out of a feed sliver by an opening cylinder that rotates in an opening cylinder housing of an open end spinning device, for delivery to a spinning rotor running at high speed in a rotor housing that can be subjected to a vacuum. The fiber guide channel is arranged in a cover element for closing the rotor housing and the input side of the fiber guide channel is matched with respect to its width to the mountings of the opening cylinder. The inlet opening and the outlet opening of the fiber guide channel have a slot-like shape and the maximum extension (B) of the inlet opening extends parallel to the rotational axis of the opening cylinder. According to the invention, the maximum extension (L) of the outlet opening of the fiber guide channel is rotated about an imaginary center line of the fiber guide channel by 90°±15° in relation to the maximum extension (B) of the inlet opening. The fiber guide channel, between the inlet opening and outlet opening, has a zone Z, which is substantially cylindrical, in that the cross-section of the fiber guide channel constantly decreases from the inlet opening to the zone Z.

Advantageous further configurations of a fiber guide channel of this type are described below.

In the configuration according to the invention, the fibers that have been combed out from the feed sliver by the opening cylinder are sucked without any problems and virtually completely into the fiber guide channel. There then follows, in a first channel portion, owing to the tapering of the fiber guide channel, an acceleration of the air and fiber flow including an increased fiber stretching and fiber bundling. This bundling takes place predominantly in the plane, in which the greatest width of the slot-shaped inlet opening lies. In this case, the channel cross-section only decreases to the extent that an adequate air throughput is ensured for the spinning process. After a zone which is as far as possible cylindrical in the central region of the fiber guide channel, the cross-sectional shape of the fiber guide channel in turn passes into a slot shape. The main extension of this slot shape, however, is rotated by about 90° relative to the slot shape of the fiber channel inlet.

This angle relates to an imaginary center line, which also follows a curve of the fiber guide channel. The angle of the section of the fiber guide channel for forming the inlet or outlet opening thus remains without influence on the claimed angle.

In the above-described manner, viewed in the longitudinal direction of the fiber channel, the projected free cross-section is reduced to the intersecting area between the two slot shapes. This reduced intersecting area is decisive for the fiber bundling, as it becomes effective when the fibers leave the fiber guide channel. Since, despite this bundling of the fiber flow substantially onto said intersecting area, the free cross-section of the fiber guide channel is not reduced to a corresponding degree, the air throughput required can nevertheless be ensured. This result cannot be achieved when an attempt is made to bring about the fiber bundling to a similar degree exclusively by tapering the fiber guide channel, as the required air throughput cannot then be ensured.

The configuration of the fiber guide channel according to the invention moreover ensures that the fibers, during their pneumatic transport from the opening cylinder to the spinning rotor, remain as far as possible without physical contact with the wall of the fiber guide channel and this has a very positive effect overall on the spinning process.

The main extension direction of the outlet opening is oriented approximately parallel to the rotor groove, resulting in a limitation of the fiber feeding to a narrow region. This narrow region ensures fiber feeding onto the rotor slide face such that, in the case of a spaced arrangement with respect to the rotor groove, an adequately long path of the fibers has to be covered up to the rotor groove, which ensures good drawing of the significant majority of the fibers.

The cylindrical channel shape may be at least approximately circular. Advantages are produced here in terms of flow compared to an oval shape which is also possible according to the invention. In principle, the cylindrical shape can also be understood as slightly conical in order to also maintain a minimum degree of air acceleration in this region.

The fiber channel may be curved in its last third with its flat portion forming there in the direction of the direction of rotation of the rotor. The wall region located inwardly in relation to the direction of curvature is more strongly curved than the opposing wall region. The described curvature of the last channel portion is used for the purpose of gradually approaching the fiber flow to the curvature of the fiber slide wall of the spinning rotor. A fiber compression is thus prevented, which could lead to significant strength losses in the finished thread. The curvature is advantageously implemented with the channel widening or flattening. The concentration of the curvature onto the inner wall of the fiber guide channel leads to a concentration of the fiber flow onto the vicinity of the outer wall region of the second channel portion; however, too sharp a deflection of the fibers in the fiber guide channel, which could cause compressions, is above all avoided.

The channel design cross-sectional area is selected over the entire channel length, regardless of the respective cross-sectional shape, which ensures maintenance of the air throughput required for the spinning process.

In an advantageous embodiment, the fiber guide channel is configured in two parts and has a substantially stationarily arranged connection body and a channel plate adapter, which is mounted so as to be easily exchangeable. In this case, a first channel portion with the slot-like inlet aperture and a preferably round outlet bore are arranged in the connection body, while the channel plate adapter has a second channel portion with a round inlet opening and an also slot-like outlet aperture, which is, however, rotated about the longitudinal axis of the fiber guide channel by about 90° in relation to the inlet opening.

The outlet opening of the first channel portion arranged in the connection body and the inlet opening of the second channel portion arranged in the channel plate adapter are advantageously matched to one another both with respect to their shape and their size. In other words, a uniform transporting air flow with a virtually disruption-free transition of the individual fibers from one channel portion to the other channel portion is provided over the entire length of the fiber guide channel. The exact agreement of the outlet opening of the connection body with the inlet opening of the channel plate adapter also makes it possible that if necessary, for example in the event of a change of batch, the channel plate adapter can be changed without problems.

The transporting air flow inside the fiber guide channel is in no way impaired by a change of this type of the channel plate adapter.

An embodiment of this type leads to a concentration of the fiber flow close to the outer wall region of the second channel portion and therefore to an advantageous bundling of the individual fibers fed on.

It is also provided, in an advantageous embodiment, that the outlet opening of the fiber guide channel is positioned in such a way that when the fibers are fed onto the fiber slide face of the spinning rotor between the feed region and the rotor opening, a fiber-free ring of at least 0.5 mm remains. A configuration and arrangement of the outlet opening of the fiber guide channel of this type ensures that virtually all the individual fibers delivered via the fiber guide channel arrive in the rotor groove and contribute to the fiber formation. In other words, the number of fibers unintentionally sucked away via the rotor opening is minimized.

It has proven particularly advantageous if the fiber guide channel has an outlet opening. the height of which is between 1.5 mm and 4.5 mm. Such dimensioning of the outlet opening makes an exactly defined depositing of these fibers possible on a region provided for this of the fiber slide face of the spinning rotor.

BRIEF DESCRIPTION OF THE DRAWINGS

The invention will be described in more detail hereinafter with the aid of an embodiment shown in the drawings, in which.

DESCRIPTION OF THE PREFERRED EMBODIMENTS

Figure 1:
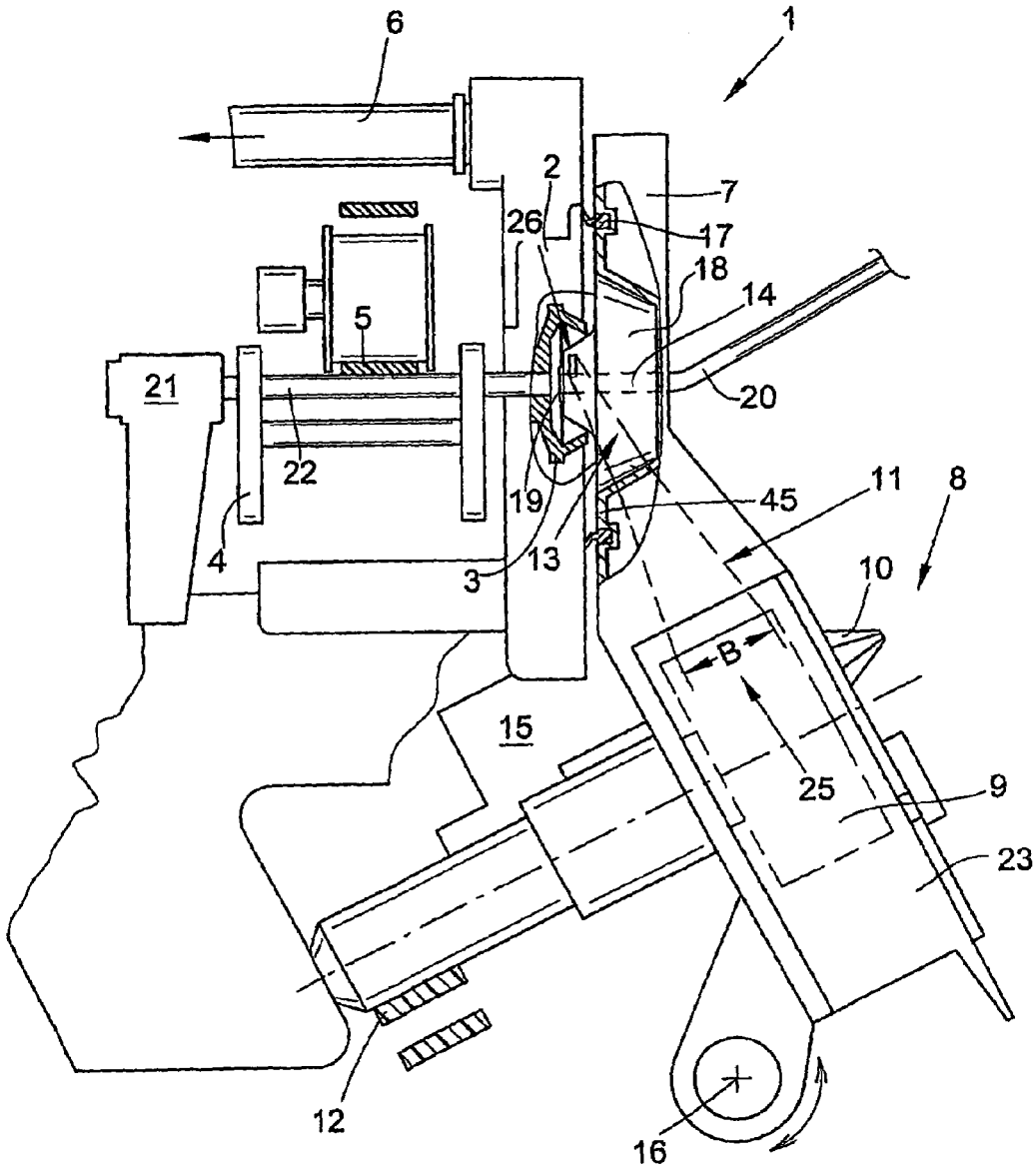
FIG. 1 shows a side view of an open end spinning device with a fiber guide channel configured according to the invention.

The open end spinning device 1 shown in FIG. 1 has, as known, a rotor housing 2, in which a spinning rotor 3 runs at a high speed during the spinning operation. In the embodiment shown, the spinning rotor 3 is supported with its rotor shaft 22 in the bearing interstices of a support disc bearing arrangement 4 and is thus fixed in the axial direction by a, for example, permanent magnetic thrust bearing 21.

The drive of the spinning rotor 3 is implemented either, as indicated, via a tangential belt 5, which is placed by means of a support roller on the rotor shaft 22, or by an individual drive. The rotor housing 2 that is open at the front per se is connected via a suction fine 6 to a vacuum source (not shown), and closed by a so-called fiber channel plate 45 during the spinning operation. The fiber channel plate 45, which is arranged on a cover element 7 which is mounted so it can be rotated to a limited extent about a pivot axis 16, rests with one sealing element 17 on the end face of the rotor housing 2.

A sliver supply and opening mechanism 8 is integrated into the cover element 7 and comprises inter cilia a sliver opening cylinder 9, a sliver intake cylinder 10 and a fiber guide channel 11. As shown in FIG. 1, the sliver opening cylinder 9 running in an opening cylinder housing 23 is driven by a tangential belt 12, for example, while the sliver intake cylinder 10 is acted upon via a drive shaft extending along the machine or, as indicated, via a single drive 15, preferably a stepping motor.

A receiver 13 that is open in the direction of the spinning rotor 3, is preferably incorporated into the fiber channel plate 45 and has a circular, conically configured contact face, for example.

Figure 3:
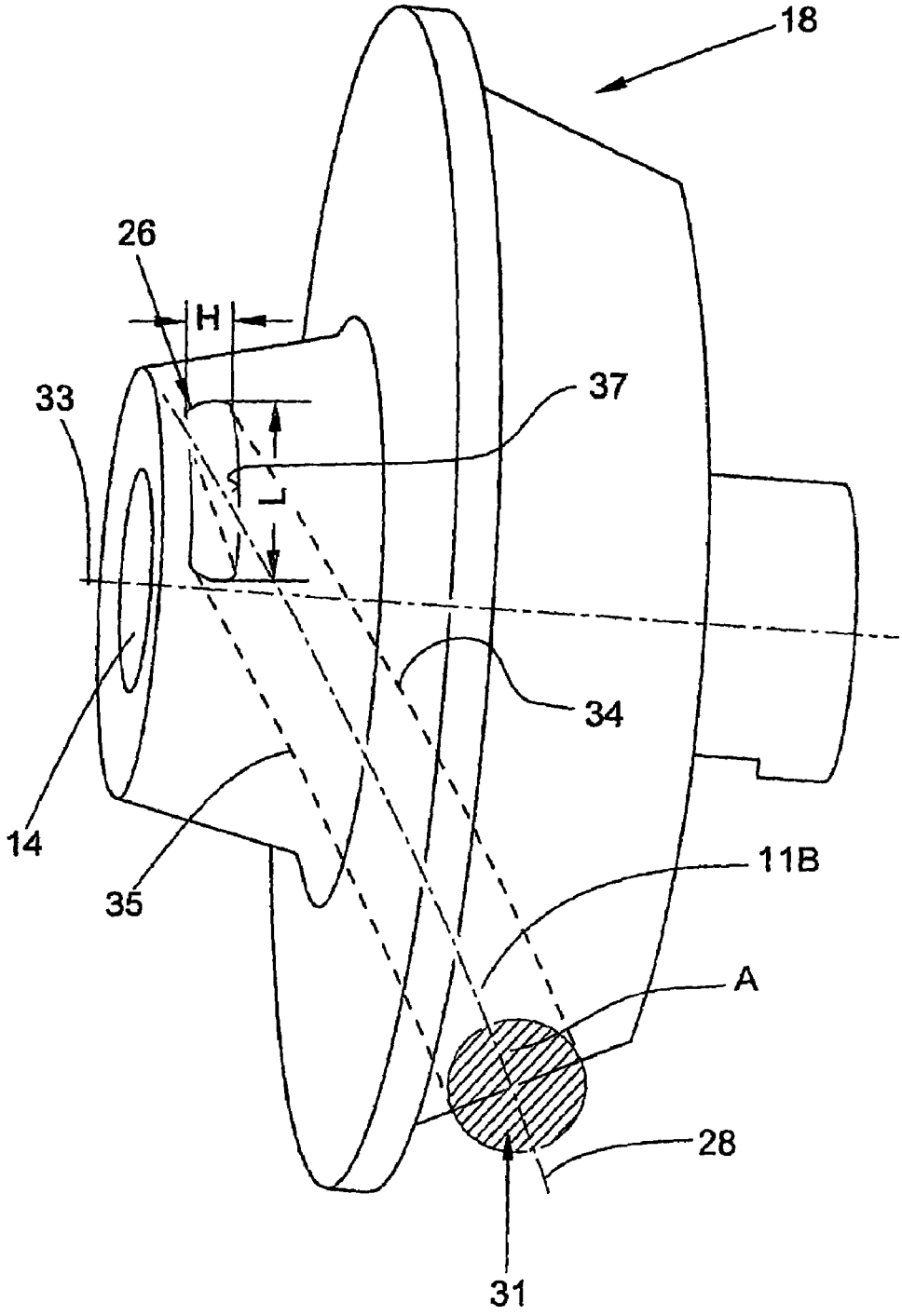
FIG. 3 shows a perspective view of a channel plate adapter, with the second channel portion of the fiber guide channel.
Figure 4:
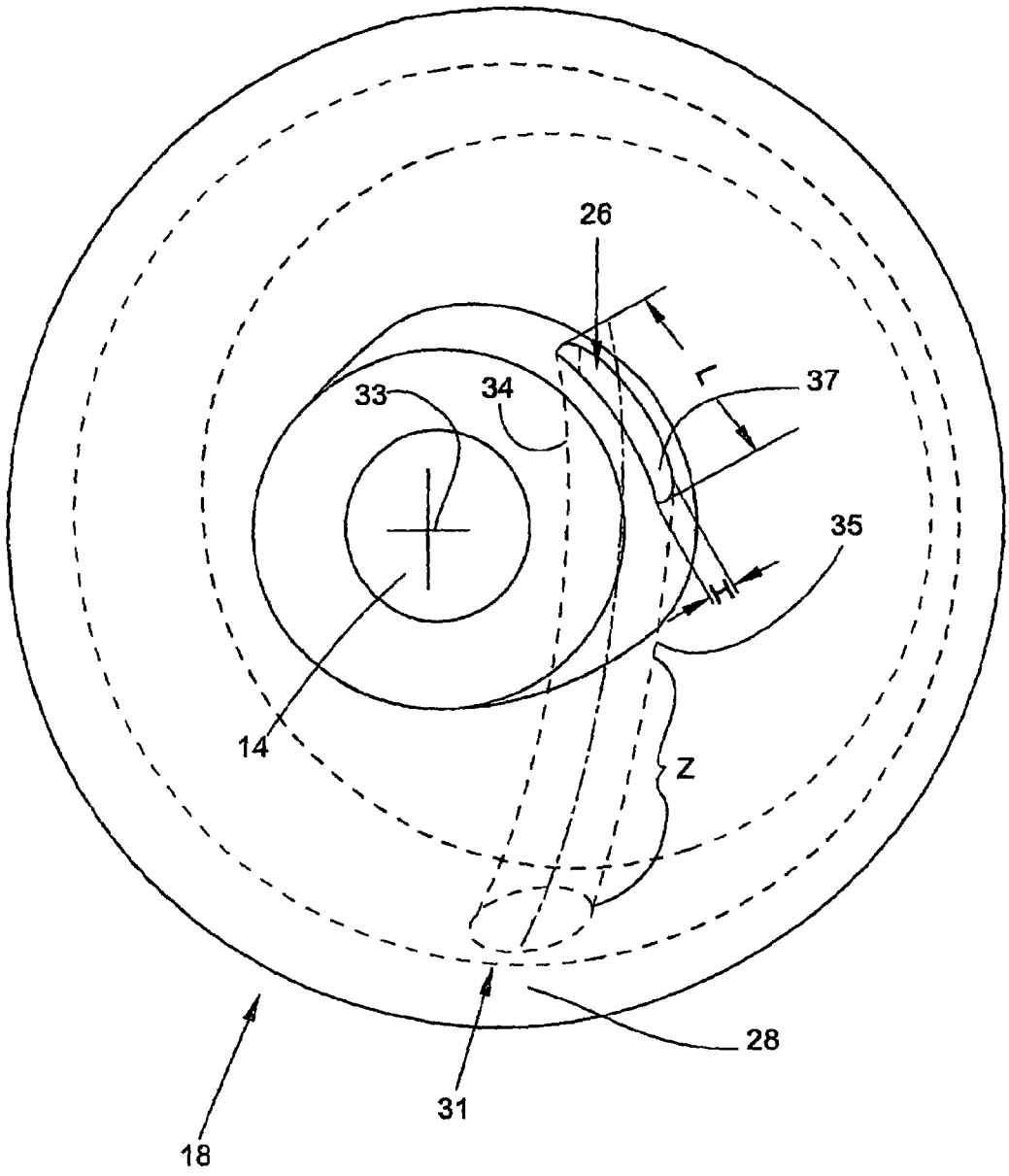
FIG. 4 shows a further view of the channel plate adapter according to FIG. 3.

A so-called channel plate adapter 18 is fixed so as to be easily exchangeable in this receiver 13, so as to be capable of orientation at a precise angle. The channel plate adapter 18, which is shown in FIGS. 3 and 4 in enlarged scale, has a central through-bore 14, in which a thread withdrawal nozzle 19 is positioned on the input side and a small thread withdrawal tube 20 is positioned on the output side. Furthermore, a channel portion 11 B of the fiber guide channel 11 with the slot-shaped outlet opening 26 and the preferably round inlet opening 31 is furthermore arranged in the channel plate adapter 18.

Figure 5:
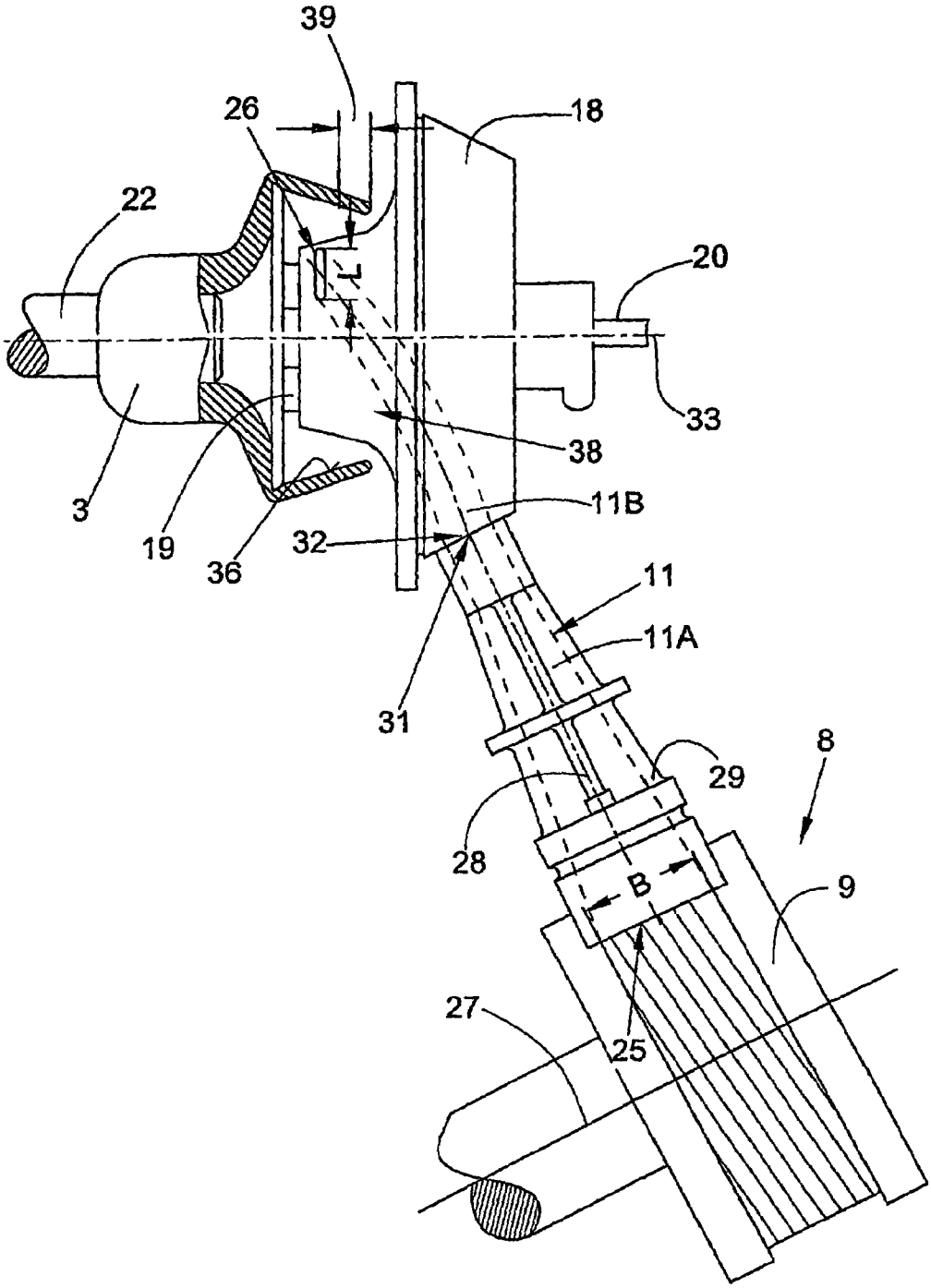
FIG. 5 shows the fiber guide channel according to the invention in detail and FIG. 6 shows a section sequence, which is produced along an imaginary center line of the fiber guide channel.

As indicated in FIG. 1 and shown in more detail in FIG. 5, the opening cylinder housing 23 is continuously pneumatically connected via the fiber guide channel 11 to the rotor housing 2. In other words, individual fibers, which are combed out from a feed sliver (not shown) by the sliver supply and opening mechanism 8, are conveyed to the rotor housing 2 via the fiber guide channel 11 and then fed onto the spinning rotor 3 running at a high speed.

As can be seen, in particular from FIG. 5, the fiber guide channel 11 is configured in two parts between its inlet opening 25 and its outlet opening 26. This means that the fiber channel 11 consists of a first fiber guide channel portion 11A and a second fiber guide channel 11B. The first fiber guide channel portion 11A, which has the inlet opening 25, matched to the mountings of the opening cylinder 9, of the fiber guide channel 11, in this case is arranged in a connection body 29, while the second fiber guide channel portion 11B, which ends in the outlet opening 26, is integrated into the channel plate adapter 18.

As shown, both the inlet opening 25 and the outlet opening 26 of the fiber guide channel 11 have a slot-like shape and are arranged rotated with respect to one another by about 90° in relation to the longitudinal axis 28 of the fiber guide channel 11. In other words the maximum extension B of the inlet opening 25 of the fiber guide channel 11 runs parallel to the rotation axis 27 of the opening cylinder 9, while the maximum extension L of the outlet opening 26 of the fiber guide channel 11 is arranged approximately orthogonally with respect to the longitudinal axis 33 of the channel plate adapter 18 and therefore orthogonally with respect to the rotational axis of the spinning rotor 3.

Figure 2B:
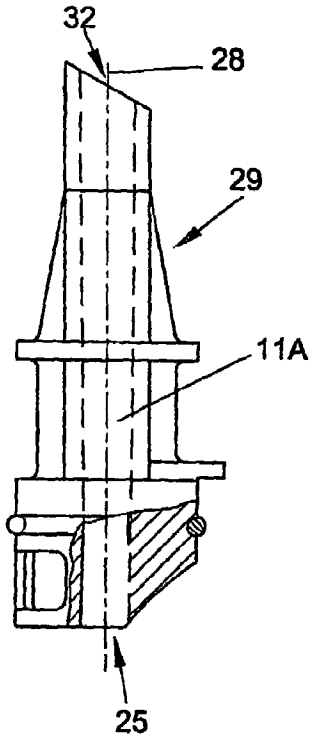
FIGS. 2*a* to 2*c* show different views of a connection body of the fiber guide channel, with the first channel portion of the fiber guide channel.
Figure 2A:
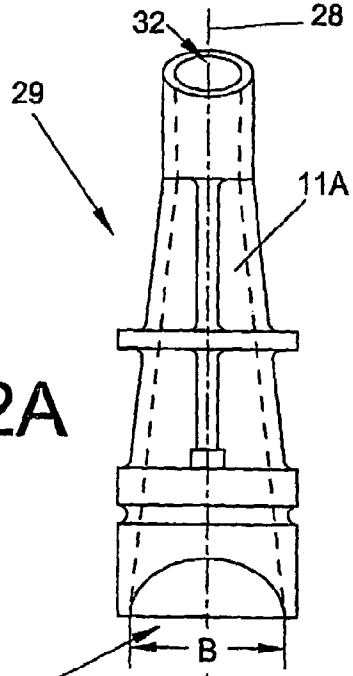
Figure 2C:
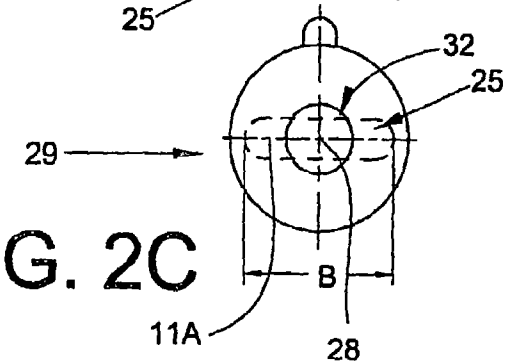

As can be seen, in particular from FIGS. 2*a* to 2*c*, the channel portion 11A arranged in the connection body 29, has a slot-like inlet opening 25, the large extension B of which runs parallel to the rotational axis 27 of the opening cylinder 9. The free cross-sectional profile of the channel portion 11A ends in a preferably circular outlet opening 32. The outlet opening 32 is. in this case, matched to the inlet opening 31 of a second channel portion 11 B both with respect to its shape and also its size. This second channel portion 11B is integrated into a channel plate adapter 18 and ends, as can be seen in particular from FIGS. 3 and 4, in a slot-shaped outlet opening 26. The second channel portion 11B, which has a virtually equally large free cross-sectional area A over its entire length, is, as shown in FIG. 4, slightly curved as a whole toward the longitudinal axis 33 of the channel plate adapter 18.

The wall portion 34 of the channel plate portion 11B adjacent to the longitudinal axis 33 of the channel plate adapter 18 is slightly more sharply curved in this case than the outer wall portion 35, which runs virtually tangentially with respect to the fiber slide face 36 of the spinning rotor 3. The outlet opening 26 of the channel plate portion 11B and therefore also of the fiber guide channel 11 in this case has a height H, which is preferably between 1.5 mm and 4.5 mm. The outlet opening 26 is arranged in this case (see FIG. 5) in such a way that a fiber-free ring 39 is produced on the fiber slide face 36 of the spinning rotor 3, the width of which toward the spinning rotor opening 37 is at least 0.5 mm but preferably significantly wider.

Figure 6:
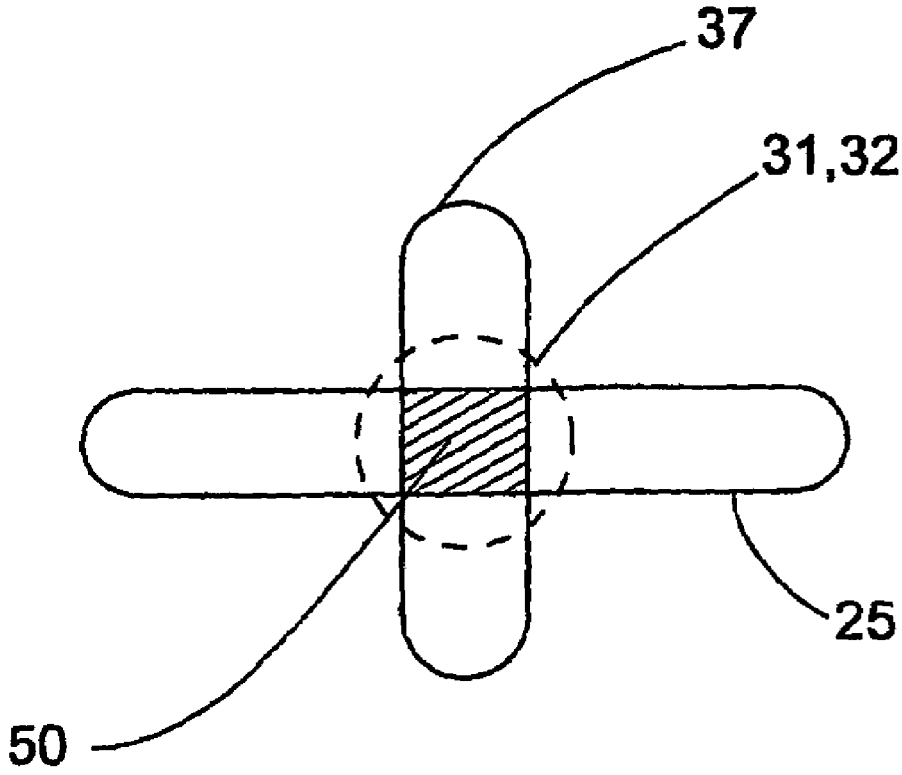

It is to be shown again in FIG. 6 how the cross-sectional area of the fiber guide channel 11 develops from the inlet opening 25 to the outlet opening 26 over a cross-section 31, 32 in a zone Z. In this case, it can be seen that the projected free cross-section 50 is significantly smaller than all the other cross-sections. For this reason, the effective fiber bundling, which takes place substantially up to the projected free cross-section 50 does not lead to a process-damaging reduction of the cross-sectional area for the air throughput.

The invention claimed is:

1. Fiber guide channel for the pneumatic transport of individual fibers, which are combed out of a feed sliver by an opening cylinder that rotates in an opening cylinder housing, of an open end spinning device, to a spinning rotor running at high speed in a rotor housing that can be subjected to a vacuum, wherein on the input side, the fiber guide channel arranged in a cover element for closing the rotor housing is matched with respect to its width to the mountings of the opening cylinder, the inlet opening and the outlet opening of the fiber guide channel have a slot-like shape and the maximum extension (B) of the inlet opening extends parallel to the rotational axis of the opening cylinder, characterized in that the maximum extension (L) of the outlet opening (26) of the fiber guide channel (11) is rotated about an imaginary center line (28) of the fiber guide channel (11) by 90°±15° in relation to the maximum extension (B) of the inlet opening (25), in that the fiber guide channel (11), between the inlet opening (25) and outlet opening (26), has a zone Z, which is substantially cylindrical, in that the cross-section of the fiber guide channel (11) constantly decreases from the inlet opening (25) to the zone Z.

2. Fiber guide channel according to claim 1, characterized in that the channel cross-section within the zone Z is at least approximately circular.

3. Fiber guide channel according to claim 1, characterized in that the fiber channel (11) is curved in its last third with its flat portion forming there in the direction of the direction of rotation of the rotor.

4. Fiber guide channel according to claim 3, characterized in that the wall region (34) located inwardly in relation to the direction of curvature is more strongly curved than the opposing wall region (35).

5. Fiber guide channel according to claim 3 characterized in that the cross-sectional area is selected over the entire channel length, regardless of the respective cross-sectional shape, throughput, which is process, is ensured.

6. Fiber guide channel according to claim 1, characterized in that the fiber guide channel (11) is configured in two parts, and consists of a channel portion (11A), arranged in a connection body (29), with the inlet opening (25) and an outlet opening (32) and a channel portion (11B), arranged in a channel plate adapter (18), with the outlet opening (26) and an inlet opening (31).

7. Fiber guide channel according to claim 1, characterized in that the wall region (37), adjacent to the spinning rotor opening (38) in the region of the outlet opening (26) is arranged such that a fiber free ring (39) of >0.5 mm is produced in the direction of the spinning rotor opening (38) during the spinning process on the fiber slide face (36) of the spinning rotor (3).

8. Fiber guide channel according to claim 1, characterized in that the height (H) of the outlet opening to be at least so large that an air sufficiently large for the spinning (26) of the fiber guide channel (11) is between 1.5 mm and 4.5 mm.

* * * * *